United States Patent [19]

Asari et al.

[11] 4,443,143

[45] Apr. 17, 1984

[54] BILLET SCALPER AND DRIVE MECHANISM THEREFOR

[75] Inventors: Akira Asari, Osaka; Tatsuhiko Noyori, Kobe; Hidehiro Tsuzuki, Kobe; Takahisa Tabuchi, Kobe; Tsuneharu Masuda, Kobe, all of Japan; Tetsuro Takehata, deceased, late of Osaka, Japan, by Akemi Takehata, legal representative

[73] Assignee: Kabushiki Kaisha Kobe Seiko Sho, Kobe, Japan

[21] Appl. No.: 355,341

[22] Filed: Mar. 8, 1982

[51] Int. Cl.[3] ..... B21C 43/02; B23D 79/12; B23P 25/00

[52] U.S. Cl. ..... 409/295; 409/298; 409/310; 409/308; 72/254; 72/40; 83/914; 29/81 G

[58] Field of Search ..... 29/81 F, 81 G, 81 R; 72/254, 40, 273.5, 263, 255; 83/914; 409/292, 294, 295, 298, 299, 300, 310, 322, 339, 303, 308

[56] References Cited

U.S. PATENT DOCUMENTS

| | | | |
|---|---|---|---|
| 2,688,400 | 9/1954 | Ansel | 72/254 |
| 2,961,742 | 11/1960 | Hatebur | 29/81 G |
| 3,528,275 | 9/1970 | Sibler | 72/273.5 |
| 3,577,759 | 5/1971 | Tandler | 72/254 |
| 3,875,781 | 4/1975 | Zilges et al. | 72/267 |
| 4,165,625 | 8/1979 | Wagner et al. | 72/253.1 |
| 4,342,212 | 8/1982 | Sibler | 72/263 |
| 4,379,398 | 4/1983 | Asari et al. | 72/255 |

FOREIGN PATENT DOCUMENTS

| | | | |
|---|---|---|---|
| 622741 | 12/1935 | Fed. Rep. of Germany | 72/265 |
| 960449 | 3/1957 | Fed. Rep. of Germany | 72/254 |
| 1387870 | 12/1964 | France | 72/270 |
| 1335820 | 10/1973 | United Kingdom | 72/265 |
| 1373676 | 11/1974 | United Kingdom | 72/253.1 |
| 459280 | 2/1975 | U.S.S.R. | 72/254 |

*Primary Examiner*—Lowell A. Larson
*Attorney, Agent, or Firm*—Oblon, Fisher, Spivak, McClelland & Maier

[57] ABSTRACT

A billet scalper including a die assembly with a scalping die, a pressing mechanism with a stem member in axial alignment with the scalping die for pressing a billet thereinto, and a chip ejector located around the circumference of the scalping die and movable axially back and forth beyond a free end face of the scalping die to remove chips therefrom. The die assembly including the scalping die is movable between a position at the center of the scalper and an outer receded position to permit easy maintenance and service of the die assembly including replacements and cleaning of scalping dies. In a preferred form, the scalper is constructed integrally with an extrusion press to perform the billet scalping operation in timed relation with the extruding operation to shorten the time of press cycle.

6 Claims, 14 Drawing Figures

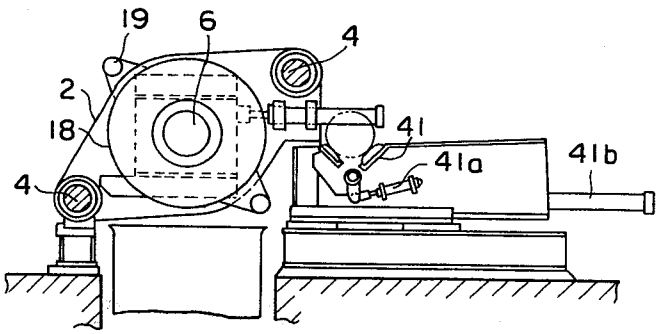
FIGURE 10(III)

BILLET SCALPER AND DRIVE MECHANISM THEREFOR

BACKGROUND OF THE INVENTION

This invention relates to a billet scalper which is constructed independently or in combination with an extrusion press.

It is known in the art to employ a billet scalper which is arranged to remove black skins and segregated alloy layers from outer surfaces of cast billets by cooperation of a die assembly including a scalping die and a pressing member.

The billet scalping operation is indispensable to indirect extrusion presses to obtain products of good quality by improving the flow of billets, as well as to direct extrusion presses in which an especially high criterion is imposed on the quality of products as in the case of aeronautical parts. Therefore, there have been proposed various scalpers intended exclusively for independent scalping operation and scalper-built-in type extrusion presses.

No matter whether it is an independent billet scalper or an extrusion press with a built-in scalper, the recent concern over the scalping operation is how the chips should be handled without impairing the accuracy of scalping. Namely, the chips which are diversified in shape and relatively bulky are difficult to handle and, if the chips deposit on the scalping die, a difficulty is encountered in handling the succeeding billets, not to mention of efficient scalping and speed-up of the press cycle.

If a black skin or other foreign matter deposits on a scalping die, there arises a necessity for cleaning it off or for replacing the die. In this connection, the conventional fixed type die assembly which is mounted at the center of the machine makes the die cleaning or replacing work difficult and compels hard labor from stationed workers.

SUMMARY OF THE INVENTION

With the foregoing situations in view, the present invention has as its object the provision of a billet scalper which is capable of stripping chips from the chip scalping die no matter whether the scalper is constructed in an independent form or in combination with an extrusion press.

It is another object of the present invention to provide a billet scalper which is constructed to permit facilitated cleaning and replacement of the die assembly including the scalping die.

It is a further object of the present invention to provide a billet scalper which is compact in construction and reliable in operation.

According to the present invention, there is provided a billet scalper comprising: a die assembly mounted on a first frame and including a scalping die; a pressing mechanism supported on a second frame opposing the first frame and having a pressing stem movable toward and away from the scalping die in axial alignment therewith for pressing a billet into the scalping die; a chip ejector movably mounted around the scalping die; and drive means for axially moving the chip ejector toward the pressing mechanism beyond a free end face of the scalping die to remove chips therefrom.

In one preferred form of the invention, the billet scalper includes a second drive means for moving the die assembly including the scalping die perpendicularly to the axis of the scalper between a scalping center position and an outer receded position.

In another preferred form of the invention, the pressing mechanism has a hollow pressing stem with a head portion movable independently of the hollow stem portion, and a piston-cylinder located concentrically with the pressing stem for driving the head portion independently toward and away from the die assembly. This arrangement contributes to shorten the stroke length of the scalping cylinders and to provide a billet scalper of compact construction.

The above and other objects, features and advantages of the present invention will become apparent from the following description and the appended claims, taken in conjunction with the accompanying drawings which illustrate by way of example preferred embodiments of the present invention.

BRIEF DESCRIPTION OF THE DRAWINGS

In the accompanying drawings:

FIG. 10(III) is a cross-section taken on line X—X of FIG. 10(I);

DESCRIPTION OF PREFERRED EMBODIMENTS

Figure 1:
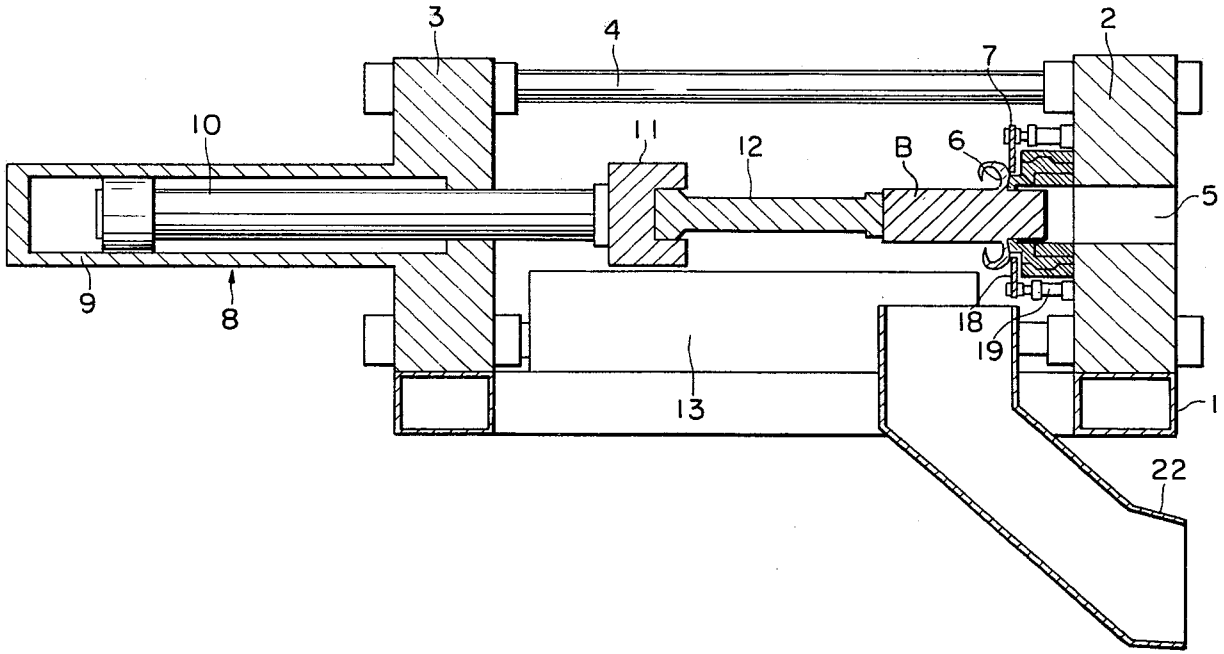
FIGS. 1 to 3 are sectional side elevations of a billet scalper embodying the present invention, showing the scalper in different phases of operation.

Referring to FIGS. 1 through 5, there is shown a first embodiment of the present invention, the billet scalper having a body of Rahmen structure constituted by opposing frames 2 and 3 which are erected at the front and rear ends of a bed 1 and rigidly connected to each other by tie rods 4 at diagonal corners thereof.

The front frame 2 is provided with a through hole 5 at the scalping center, and a scalping die assembly 7 including a scalping die 6 is mounted on the rear side of the front frame 2, namely, on one side of the front frame 2 facing the rear frame 3.

On the other hand, a pressing mechanism 8 is mounted on the other frame 3 at the scalping center or in axial alignment with the scalping die 6, the pressing mechanism 8 including a scalping cylinder 9, a piston ram 10 fitted fluid-tight in the cylinder 9, and a pressing stem 12 provided at the fore end of the piston ram 10 through a crosshead 11. A billet B which is fed to a centered position between the pressing stem 12 and scalping die 6 is pressed against the scalping die 6 by an expanding operation of the pressing mechanism 8, and, after scalping, the pressing stem 12 is retracted to the original position by a contracting operation of the pressurizing mechanism 8. In this embodiment, the crosshead 11 is adapted to be guided by a pair of slide guide members 13 on the bed 1 in order to ensure accurate back and forth movements of the crosshead 11.

Figure 5:
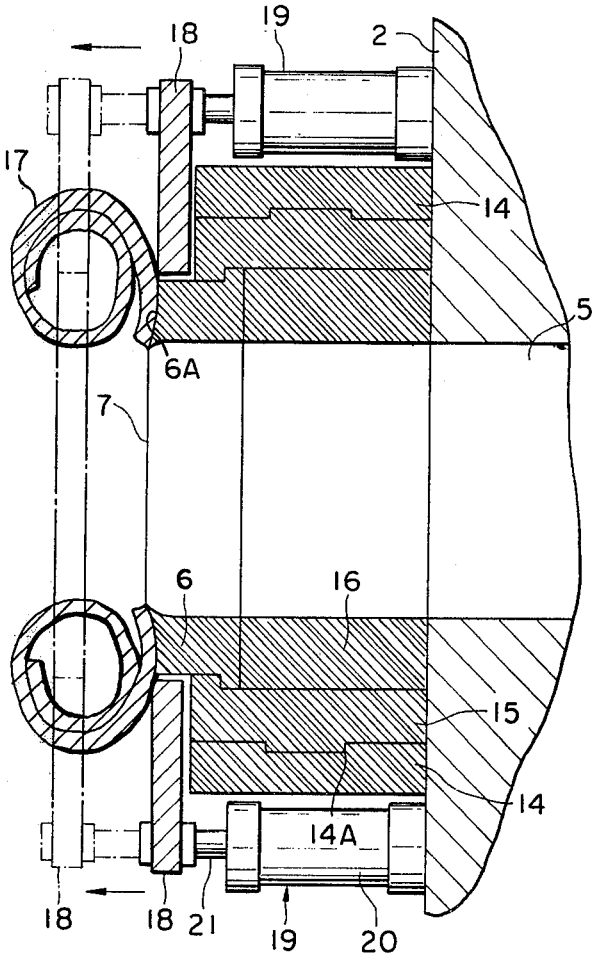
FIG. 5 is a fragmentary sectional view showing essential component parts on an enlarged scale.

As shown particularly in FIG. 5, the die assembly 7 is provided with a pair of upper and lower die holder guides 14 which are mounted on the frame 2, a die holder 15 which is fitted in the die holder guides 14, and a scalping die 6 which is fitted in the die holder 15 through a die backer 16. The scalping die 6 is provided on its end face 6A with an arcuate guide surface for curling chips 17 into the so-called spiral form.

A chip ejector 18 which has its inner peripheral edge 18A formed into an annular shape in this particular embodiment is fitted on the outer periphery of the scalping die 6. A pair of drive units 19 are mounted on the frame 2 for moving the chip ejector 18 axially toward and away from the pressing mechanism 8.

In this particular embodiment, each drive unit 19 consists of a cylinder 20 which is fixedly mounted on the frame 2 and a piston ram 21 which is fitted fluid-tight in the cylinder 20, with the fore end of the piston ram 21 fixedly connected to the chip ejector 18. In FIGS. 1 to 4, the reference numeral 22 indicates a chute for discharging the ejected chips out of the machine.

In operation of the above-described first embodiment, as a billet B is fed between the scalping die 6 and pressing stem 12 by a billet loader which is not shown, a fluid pressure (oil pressure) is applied to the pressurized mechanism 8 in an expanding direction to press the billet B against the die 6 by the pressing stem 12, scalping the skin of the billet B along the entire length thereof as shown in FIGS. 1 and 5. The chips which are curled into a spiral form under the guidance of the end face 6A of the die 6 sometimes tend to deposit on the end face 6A as shown in FIG. 5.

Figure 2:
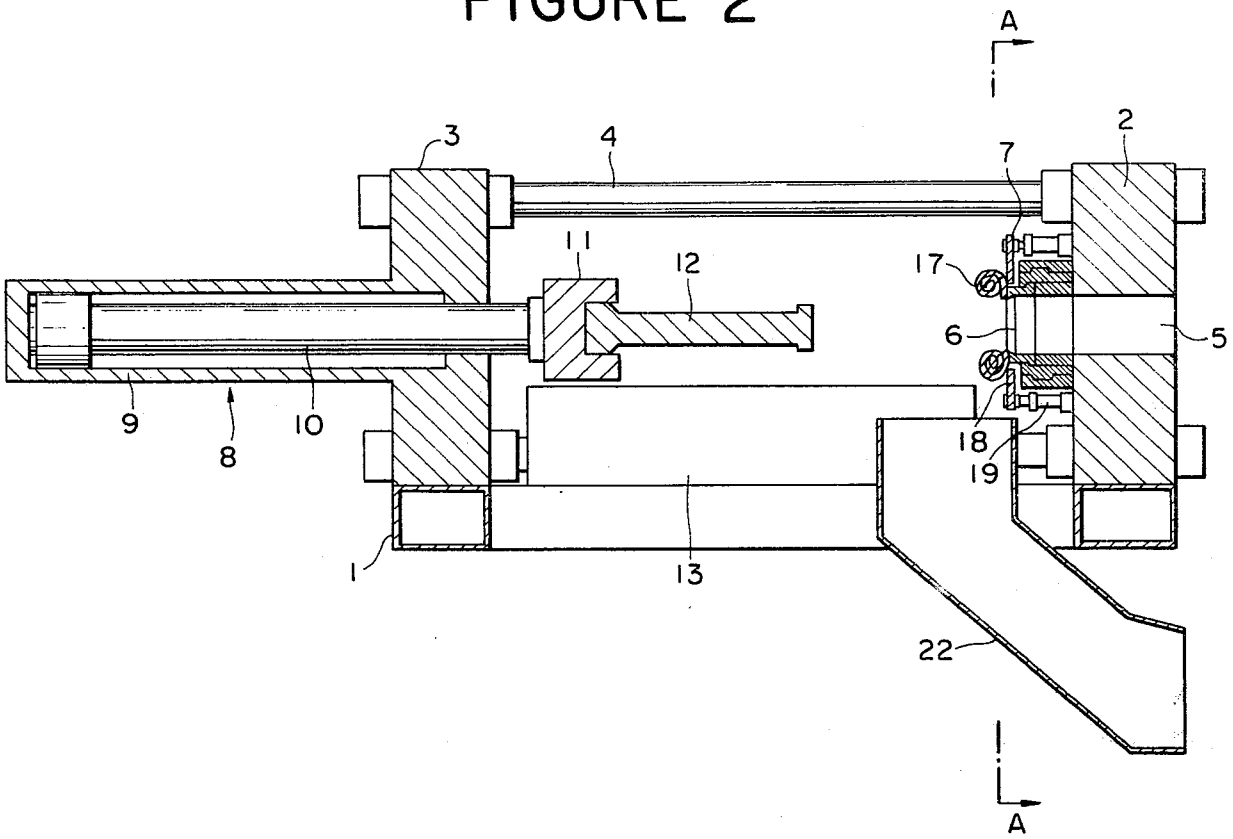
Figure 3:
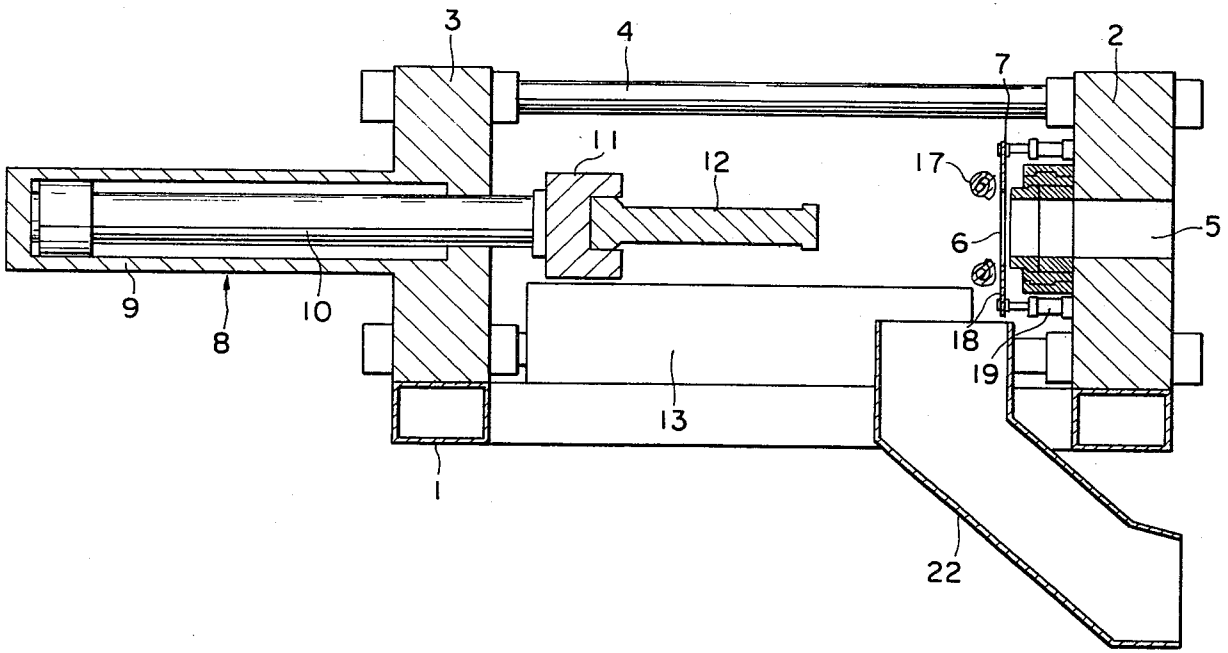
Figure 4:
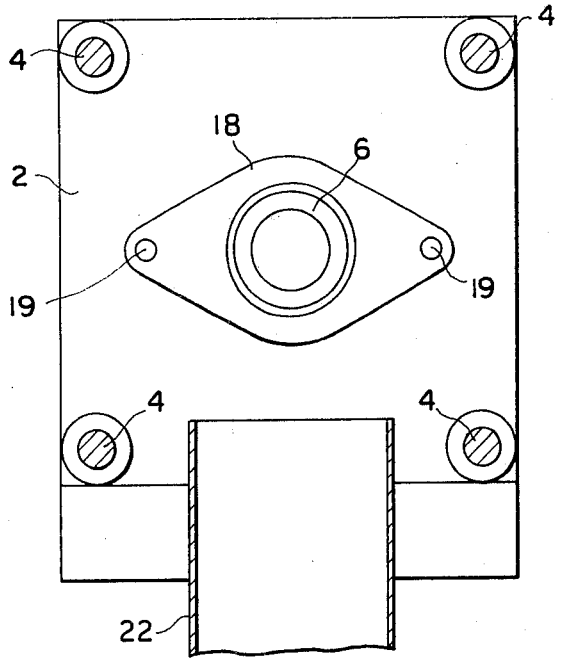
FIG. 4 is a sectional view taken on line A—A of FIG. 2.

Therefore, after retracting the pressurizing stem 12 as shown in FIG. 2, the drive units 19 are extended in the present embodiment as indicated in phantom in FIG. 5, moving the chip ejector 18 axially beyond the end face 6A of the scalping die 6. As a result, the chips 17 are removed from the end face 6A and discharged out of the machine through the chute 22 as shown in FIG. 3. In the meantime, the chip ejector 18 is retracted to its original position by a contracting operation of the drive units 19 until the chip ejection in the next cycle of operation.

Figure 6:
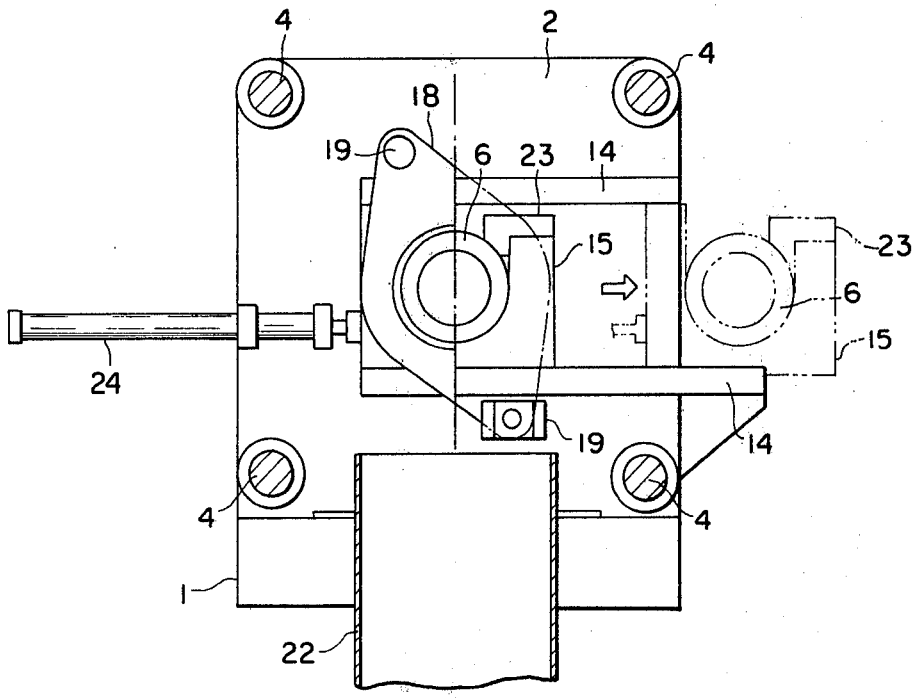
FIG. 6 is a view similar to FIG. 4 but showing another embodiment of the present invention.

FIG. 6 illustrates a second embodiment of the present invention, where those component parts which have correspondents in the first embodiment are designated by corresponding or like reference numerals.

As seen in FIG. 6, a die holder 15 of U-shape supports a scalping die 6 through a die retainer 23, and slide guide surfaces 14A of die holder guides 14 are formed perpendicular to the axis of the press to move the die 6 and die holder 15 along the guide surfaces 14A between a position at the scalping center and an outer receded position. In this particular embodiment, telescopic piston-cylinders 24 are employed as the drive units.

Therefore, in the second embodiment, the die 6 and die holder 15 are movable into a position away from the chip ejector 18 which is left at the scalping center, as indicated in phantom in FIG. 6, permitting easy access to the die assembly for facilitated and accurate handling of the die 6 in die cleaning, replacing or other operations while retaining the advantages of the first embodiment.

Figure 7:
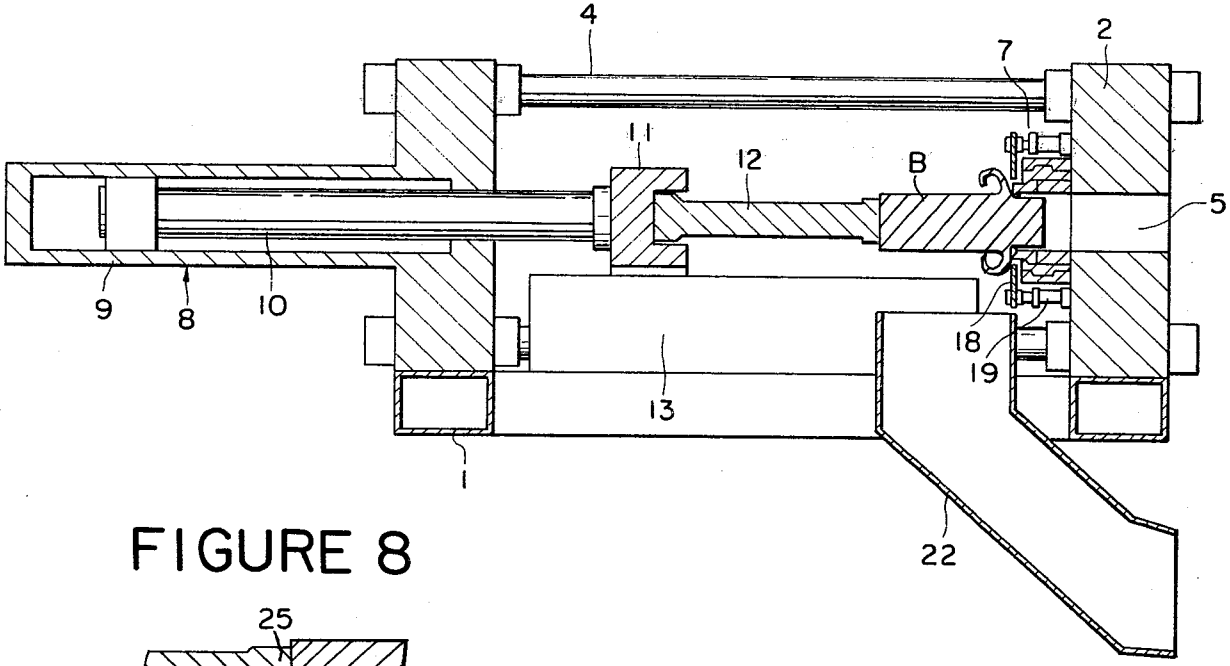
FIG. 7 is a sectional side elevation of a third embodiment of the present invention.
Figure 8:
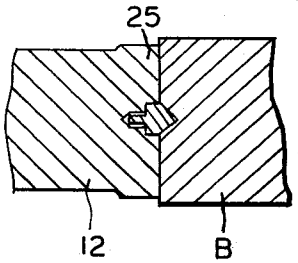
FIG. 8 is a fragmentary sectional view showing part of the embodiment of FIG. 7 on an enlarged scale.

FIGS. 7 and 8 depict a third embodiment (with an additional component), in which a sharp-pointed projection 25 is attached to the end face of the pressurizing stem 12 of the first and second embodiments. In the particular example shown, the projection 25 is detachably secured to the pressurizing stem 12 by means of a screw system.

In the scalping operation by the third embodiment, it is possible to hold the billet B in axial alignment with the pressurizing stem 12 and shaving die 6 by the sharp-pointed projection 25 to ensure the scalping operation to be effected uniformly and accurately over the entire length of the billet B.

Figure 9:
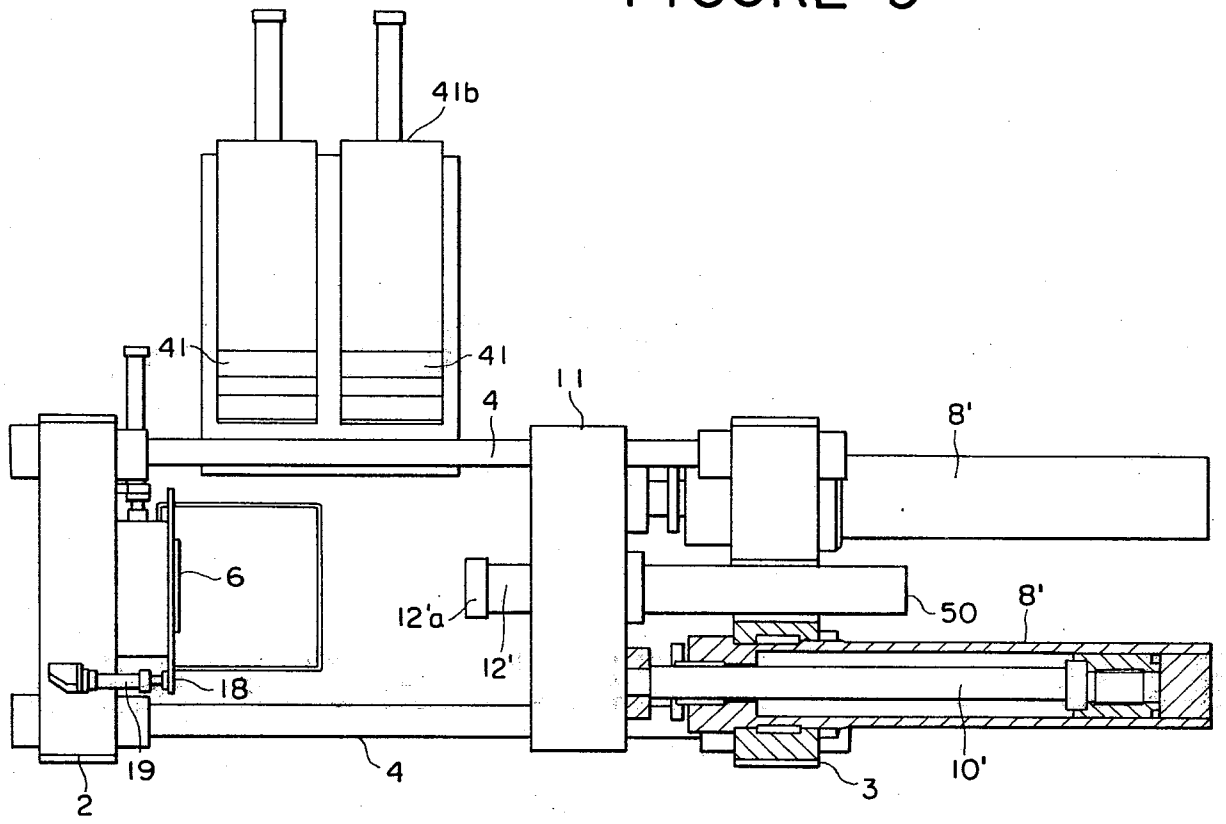
FIG. 9 is a partly sectioned plan view of a modified billet scalper according to the present invention.
Figure 10I:
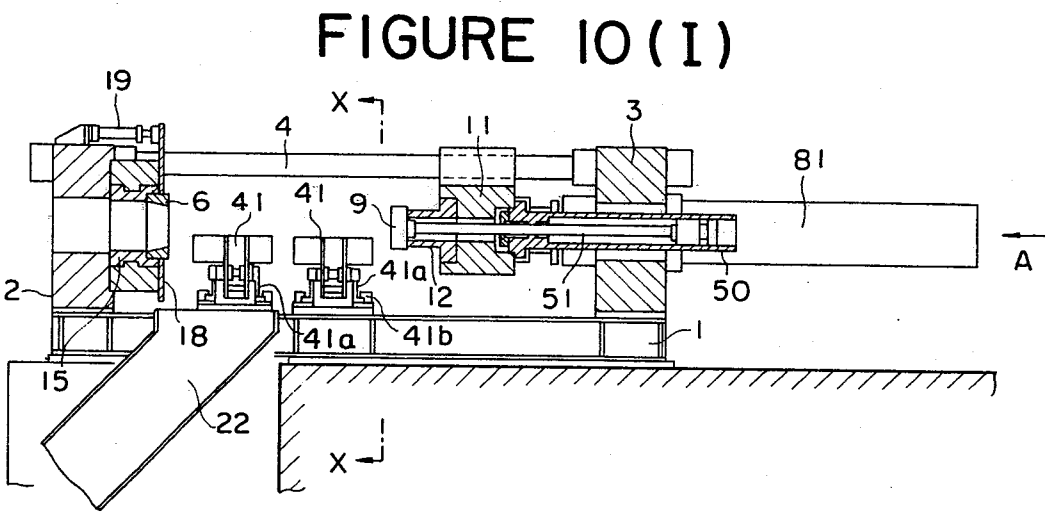
FIG. 10(I) is a longitudinally sectioned side elevation of the billet scalper of FIG. 9.
Figure 10:
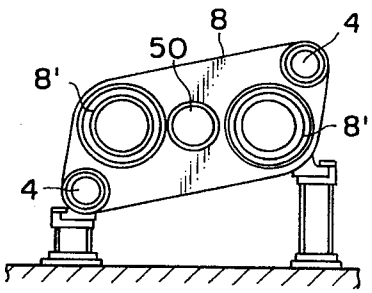
FIG. 10(II) is an elevation of a pressing drive mechanism of the modified billet scalper of FIG. 9.

Referring to FIGS. 9 and 10(I) to 10(III), there is shown a further embodiment of the present invention, which employs a billet advancing cylinder to shorten the stroke of the scalping cylinder or cylinders. Similarly to the foregoing embodiments, a cylinder frame 3 and a platen 2 are opposingly mounted on a bed 1 and connected with each other by tie rods 4. Mounted on the cylinder frame 2 are scalping cylinders 8' which support on the respective piston rods 10' a crosshead 11' with a hollow pressing stem 12' projected from the center thereof. Mounted concentrically with the pressing stem 12' is a billet advancing cylinder 50 which has its piston rod 51 extended through the stem 12' and connected to a stem head **12'*a* located separably at the fore end of the stem 12'. Designated at 41 are billet loaders located on one side of the scalper between the platen 2 and cylinder frame 3 for feeding billets one after another to the scalping center. Similarly to the foregoing embodiments, an axially reciprocable chip ejector 18 is provided around a scalping die 6 which is mounted on the platen 2 through a die holder 15 for ejecting the chips resulting from the scalping operation. Indicated at 41*a* is a mechanism for opening and closing the billet loader 41, at 41*b* a mechanism for moving the billet loader 41 toward and away from the scalping center, at 19 a mechanism for axially reciprocating the chip ejector 18, and at 22 a drive chip discharging chute. These mechanisms for controlling the movements and operations of the billet loader 41 and chip ejector 18** may be of conventional construction.

Figure 11:
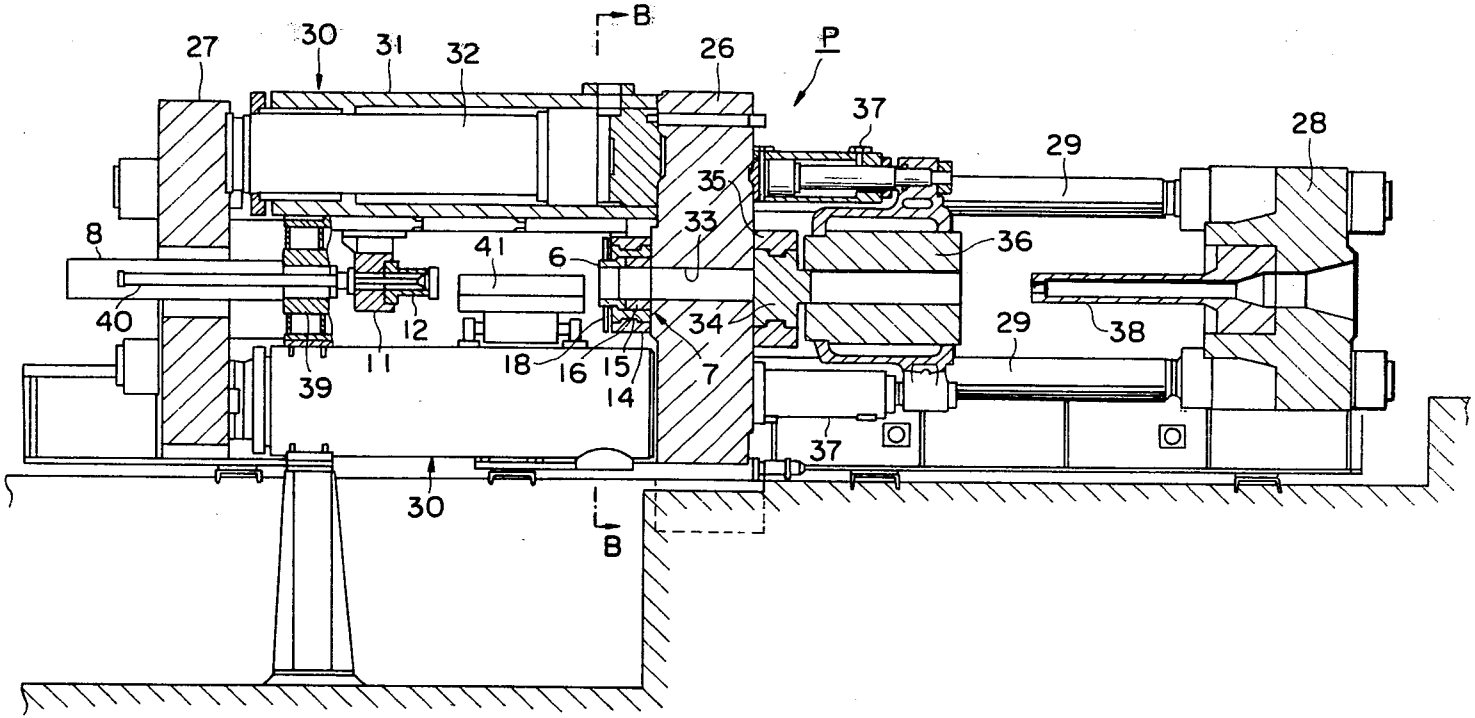
FIG. 11 is a sectional side elevation of a pull-back type extrusion press incorporating the billet scalper of the present invention.
Figure 12:
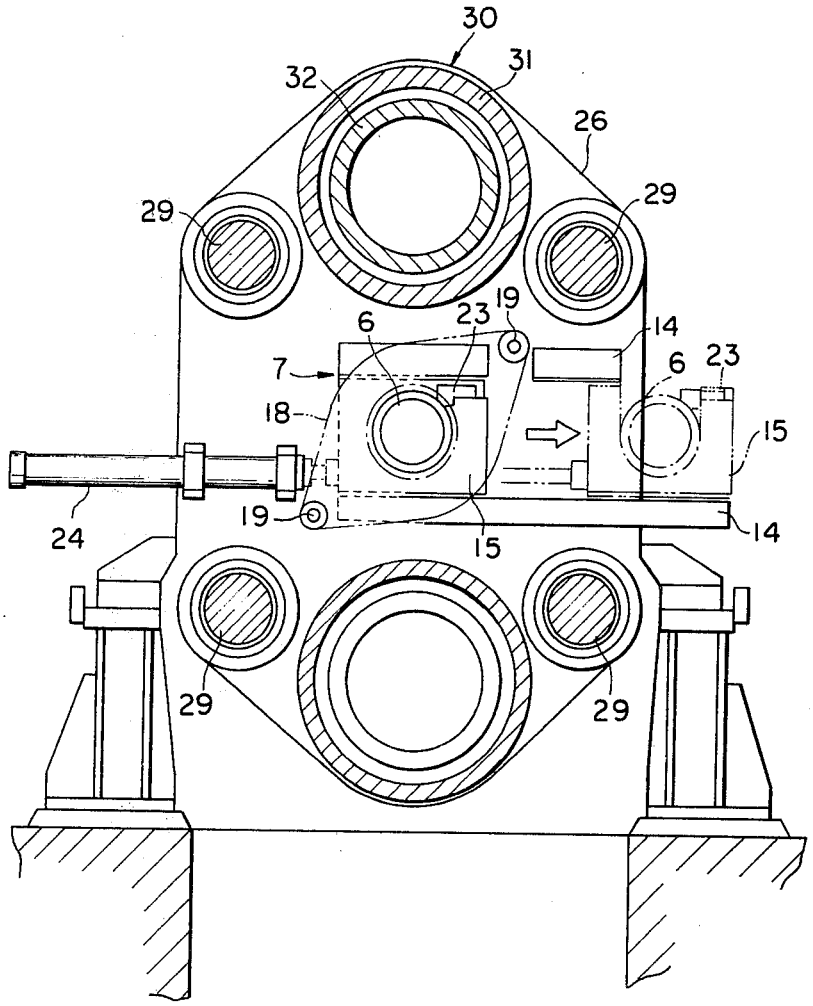
FIG. 12 is a sectional view taken on line B—B of FIG. 11.

FIGS. 11 and 12 shows the billet scalper of the present invention as incorporated into a pull-back type extrusion press P, in which indicated at 26 is a fixed platen and at 27 and 28 are movable platens which are positioned on opposite sides of the fixed platen 26 and rigidly connected with each other by diagonally disposed tie rods 29.

Interposed between the fixed and movable platens 26 and 27 are a pair of upper and lower press power generators 30 which consists of a main cylinder 31 mounted on the fixed platen 26 and a main ram 32 fitted fluid-tight in the main cylinder 31.

The fixed platen 26 is provided with a through hole 33 at the press center. Provided forward (as seen in the pressing direction) of the through hole 33 is a closure block 34 which is slidable between a position at the press center and an outer receded position perpendicularly to the axis of the press along guides 35 by operation of a piston-cylinder, not shown, for opening and closing the through hole 33.

Provided between the fixed and movable platens 26 and 28 are a container 36 and piston-cylinders 37 for clamping the container 36. The reference numeral 38 denotes a die stem which is mounted on the movable platen 28 at the press center.

Further, a scalping die assembly as exemplified in FIG. 6 is mounted on the rear side of the fixed platen 26, and a scalping frame 39 is provided on the main cylinders 31 to support thereon a billet pressing mechanism 8 with a pressing stem 12, and a billet advancing cylinder 40. The construction of the just-mentioned die assembly 7 is same as in the first to third embodiments so that common component parts are designated by common reference numerals. In FIG. 9, the reference numeral 41 denotes a billet loader.

In the embodiment shown in FIGS. 11 and 12, a billet is charged between the pressing stem 12 and scalping die 6 by the billet loader 41 and then scalped axially over the entire length thereof by cooperation of the pressing stem 12 and scalping die 6. The scalped billet remains in the through hole 33, while the chips 17 resulting from the scalping operation are removed from the end face of the die 6 by moving the chip ejector 18 in the pressing direction through extension of the drive units 19.

The replacement or cleaning or other maintenance and service of the die 6 can be carried out easily outside the machine as shown in phantom in FIG. 12 by extending the drive units 24.

In the meantime, the scalped billet is charged into the container 36 by operation of the billet advancing cylinder 40 and the rear opening of the container 36 is closed by the closure block 34. After clamping the container 36 in position by the clamping cylinders 37, pressure medium is supplied to the press power generator 30, moving the movable platens 27 and 28 to the left in the example shown in FIG. 9 to extrude the billet (rightward in the same figure) through the die stem 38.

In the embodiment shown in FIG. 11, the billet scalper is built into an extrusion press so that the scalping operation can be performed in relation with the extrusion press cycle in such a manner as to shorten the press cycle, in addition to an advantage that some component parts can be used commonly with the extrusion press.

It will be appreciated from the foregoing description that the billet scalper can remove the chips 17 from the scalping die in a secure and facilitated manner by means of the chip ejector 18. Since the chip ejector 18 is axially reciprocable, it can remove the chips securely without interfering with the scalping operation.

Further, in the embodiment in which the die assembly 7 including the scalping die 6 is movable between a position at the center of the scalper and an outer stand-by position, the replacements and cleaning of the die can be carried out quickly and safely with extremely lessened labor. In the case of the embodiment with a projection 25 on the end face of the presser stem 12, the billet is held in a correct posture and free of fluttering during the scalping operation to permit uniform scalping by a reduced power. Moreover, it is possible to shorten the press cycle while attaining the afore-mentioned objects, by providing the scalper including the die assembly 7 on an extrusion press P.

What is claimed is:

1. A billet scalper, comprising:

a die assembly mounted on a first frame and including a scalping die;

a pressing mechanism supported on a second frame opposing said first frame and having a pressing stem movable toward and away from and in axial alignment with said scalping die for pressing a billet against said scalping die;

a chip ejector movably mounted around the circumference of said scalping die; and drive means mounted on said first frame for axially moving said chip ejector toward said pressing mechanism beyond one end face of said scalping die to remove chips therefrom.

2. A billet scalper as set forth in claim 1, further comprising drive means for moving said die assembly including said scalping die perpendicularly to the axis of the scalper between a position at the center of said scalper and an outer stand-by position.

3. A billet scalper as set forth in claim 1, further comprising a sharp-pointed projection provided at the fore end face of said pressing stem.

4. A billet scalper as set forth in claim 1, wherein said scalper is incorporated in to a pull-back type extrusion press having a fixed center platen and fore and rear movable platens located on the fore and rear sides of said fixed platen and connected with each other by tie rods, and a press power generator, said die assembly including said scalping die being mounted on said fixed center platen movably perpendicularly to the axis of said press between a position at the press center and an outwardly shifted position.

5. A billet scalper as set forth in claim 1, wherein said pressing stem has a hollow body portion and a head portion movable independently of said hollow body portion, and said pressing mechanism is provided with a piston-cylinder for driving said head portion of said pressing stem independently toward and away from said die assembly.

6. A billet scalper as set forth in claim 1 wherein said chip ejector comprises a plate mounted on said drive means, said plate including an opening closely surrounding said die.

* * * * *